US007559297B2

(12) United States Patent
Ma

(10) Patent No.: US 7,559,297 B2
(45) Date of Patent: Jul. 14, 2009

(54) PORTABLE ENGINE

(76) Inventor: Yunfeng Ma, No. 2 Jishui Road, Jingiao Development Zone, Mudu Town, Wuzhong District, Suzhou, Jiangsu Province (CN)

( * ) Notice: Subject to any disclaimer, the term of this patent is extended or adjusted under 35 U.S.C. 154(b) by 147 days.

(21) Appl. No.: 11/840,413

(22) Filed: Aug. 17, 2007

(65) Prior Publication Data

US 2009/0044781 A1 Feb. 19, 2009

(51) Int. Cl.
*F01P 1/02* (2006.01)

(52) U.S. Cl. ..... 123/41.7; 123/195 C

(58) Field of Classification Search ..... 123/41.7, 123/195 C, 198 E

See application file for complete search history.

(56) References Cited

U.S. PATENT DOCUMENTS 5,977,667 A * 11/1999 Hirose ..... 310/51
6,378,468 B1 * 4/2002 Kouchi et al. ..... 123/41.56
6,378,469 B1 * 4/2002 Hiranuma et al. ..... 123/41.56
6,489,690 B1 12/2002 Hatsugai et al. ..... 290/1
7,146,962 B2 12/2006 Sugimoto et al. ..... 123/198
7,392,770 B2 * 7/2008 Xiao ..... 123/41.7
2002/0170523 A1 * 11/2002 Eberhardt et al. ..... 123/195 C
2008/0048510 A1 * 2/2008 Onodera et al. ..... 310/52
2008/0252080 A1 * 10/2008 Xiao ..... 290/1 A

* cited by examiner

*Primary Examiner*—Hai H Huynh
(74) *Attorney, Agent, or Firm*—Woodcock Washburn LLP

(57) ABSTRACT

A portable engine, comprising an engine casing, an air deflector cover, a fan and an exhaust pipe; a left upper baffle plate and a right upper baffle plate at the upper part of the engine constitute two left and right upper air ducts together with a cylinder head cover and the engine casing; a left lower baffle plate and a right lower baffle plate at the lower part of the engine constitute two left and right lower air ducts together with the engine casing; and a base plate of the engine and the engine casing constitute a bottom air duct. The portable engine can specifically cool each part through controlling air intake of each air duct, thus attaining better cooling effect for the engine.

4 Claims, 6 Drawing Sheets

PORTABLE ENGINE

FIELD OF THE INVENTION

The present invention relates to a portable engine.

BACKGROUND OF THE INVENTION

When an engine works, temperature of the cylinder cooling fin is very high, while temperature of the lower part of the casing is a little bit lower. A traditional portable engine adopts a design of an integrated air duct, which cools inner parts with cooling air drawn in by a fan and then expels through a vent groove. In such a way, direction and flow of cooling air cannot be well controlled, the cylinder head cover cannot be well cooled, and it is possible to heat the low-temperature part of the casing with hot air at the cylinder head cover.

SUMMARY OF THE INVENTION

A purpose of the present invention is to provide a portable engine, which has five air ducts and can specifically cool each part through controlling air intake of each air duct, thus attaining better cooling effect for the engine.

An embodiment of the present invention is as follows: a portable engine, comprising an engine casing, an air deflector cover, a fan and an exhaust pipe; a left upper baffle plate and a right upper baffle plate at the upper part of the engine constitute two left and right upper air ducts together with a cylinder head cover and the engine casing; a left lower baffle plate and a right lower baffle plate at the lower part of the engine constitute two left and right lower air ducts together with the engine casing; and a base plate of the engine and the engine casing constitute a bottom air duct.

A further embodiment of the present invention is as follows: a portable engine, comprising an engine casing, an air deflector cover, a fan and an exhaust pipe; a left upper baffle plate and a right upper baffle plate at the upper part of the engine constitute two left and right upper air ducts together with a cylinder head cover and the engine casing; a left lower baffle plate and a right lower baffle plate at the lower part of the engine constitute two left and right lower air ducts together with the engine casing; and a base plate of the engine and the engine casing constitute a bottom air duct.

A left convex rib extends inward at the junction between the left upper baffle plate and the left lower baffle plate; a right convex rib extends inward at the junction between the right upper baffle plate and the right lower baffle plate; the left and right upper air ducts are composed of the left convex rib, the right convex rib, the cylinder head cover and the engine casing; an upper convex rib extends upward respectively on the left and right sides of the base plate of the engine; the bottom air duct is composed of the two upper convex ribs and the engine casing; and the left and right lower air ducts are composed of the left convex rib, the right convex rib, the upper convex rib and the engine casing.

A more detailed embodiment of the present invention is as follows: a portable engine, comprising an engine casing, an air deflector cover, a fan and an exhaust pipe; a left upper baffle plate and a right upper baffle plate at the upper part of the engine constitute two left and right upper air ducts together with a cylinder head cover and the engine casing; a left lower baffle plate and a right lower baffle plate at the lower part of the engine constitute two left and right lower air ducts together with the engine casing; and a base plate of the engine and the engine casing constitute a bottom air duct.

A left convex rib extends inward at the junction between the left upper baffle plate and the left lower baffle plate; a right convex rib extends inward at the junction between the right upper baffle plate and the right lower baffle plate; the left and right upper air ducts are composed of the left convex rib, the right convex rib, the cylinder head cover and the engine casing; an upper convex rib extends upward respectively on the left and right sides of the base plate of the engine; the bottom air duct is composed of the two upper convex ribs and the engine casing; and the left and right lower air ducts are composed of the left convex rib, the right convex rib, the upper convex rib and the engine casing.

The two lower air ducts are provided at the end close to the fan respectively with an isolating plate, which is provided with several small vent holes and is on the engine casing.

The present invention has the following advantages:

1. The present invention cools the cylinder head directly with the two upper air ducts, which do not use any windshield opening on the engine casing, thus making the cylinder head being cooled with enough amount of air.

2. The heat produced by mechanical movements of the lower part of the engine during the engine operation and the heat conducted from the cylinder head are dissipated through the two lower air ducts, where the temperature is slightly lower and there is no need for too large air flow, and therefore the isolating plate with small vent holes is provided at the vent of the two lower air ducts, which can appropriately reduce air flow.

3. The bottom air duct of the present invention can cool the cooling fin at the bottom of the engine casing, and therefore can well lower temperature of the engine oil.

4. The present invention has five air ducts, and can specifically cool each part through controlling air intake of each air duct, thus attaining better cooling effect for the engine.

BRIEF DESCRIPTION OF THE DRAWINGS

The present invention will be further described below according to drawings and embodiments.

DETAILED DESCRIPTION OF ILLUSTRATIVE EMBODIMENTS

Figure 1:
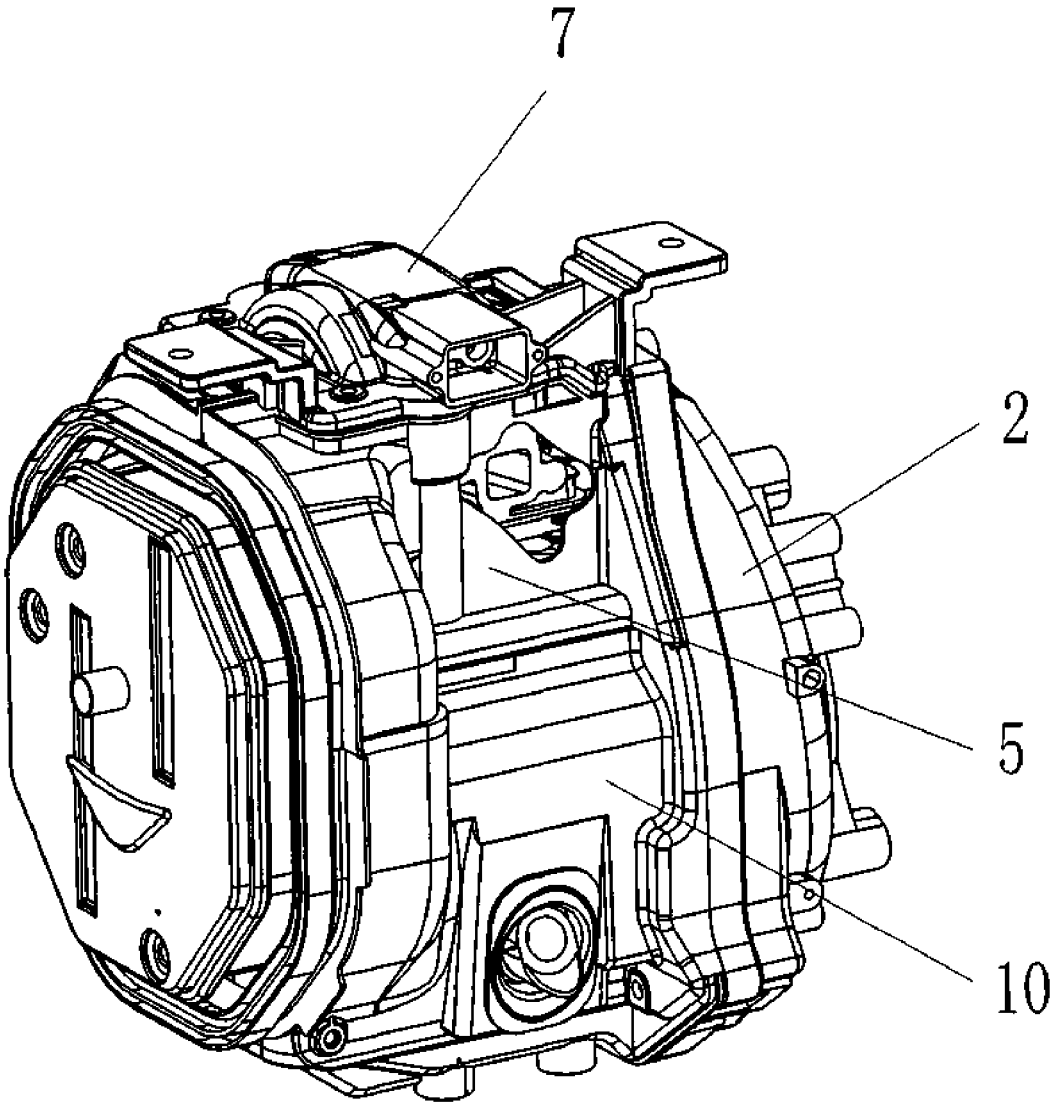
FIG. 1 is a stereoscopic drawing of the present invention.
Figure 2:
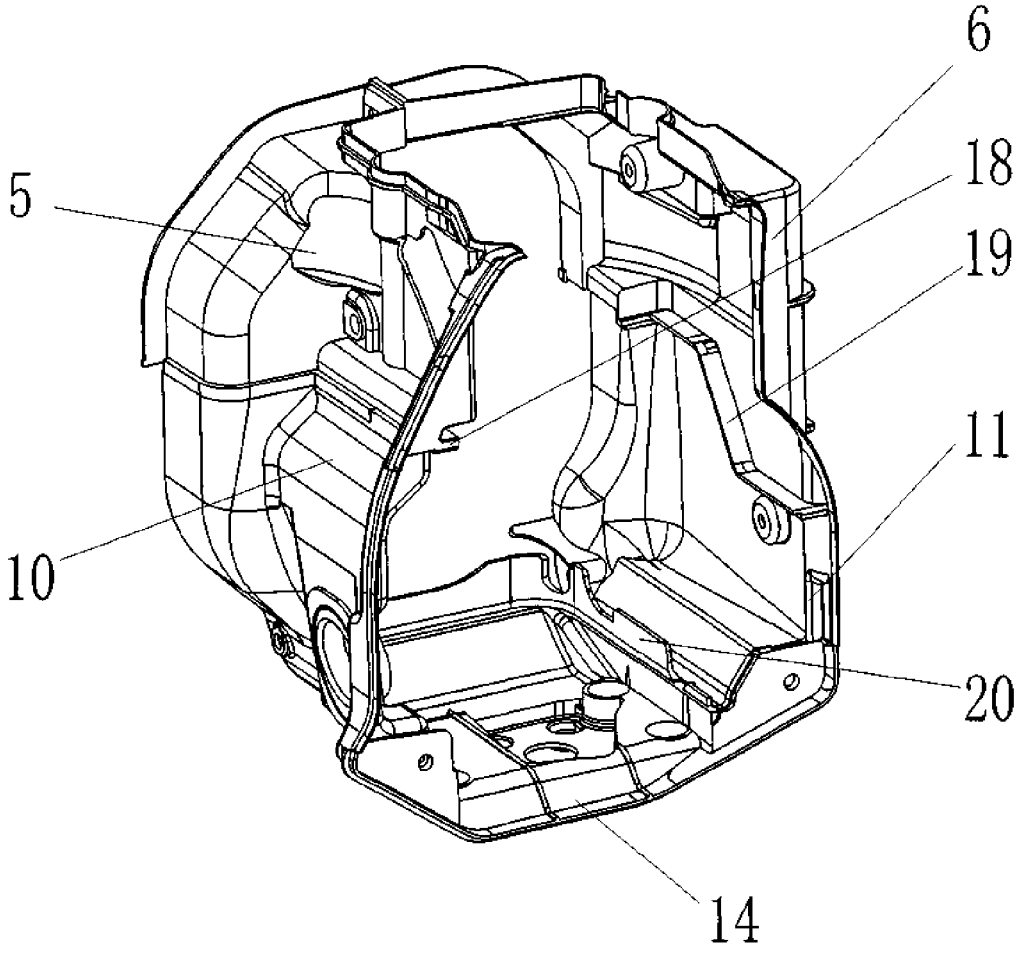
FIG. 2 is an assembly drawing of the present invention (without the power part).
Figure 3:
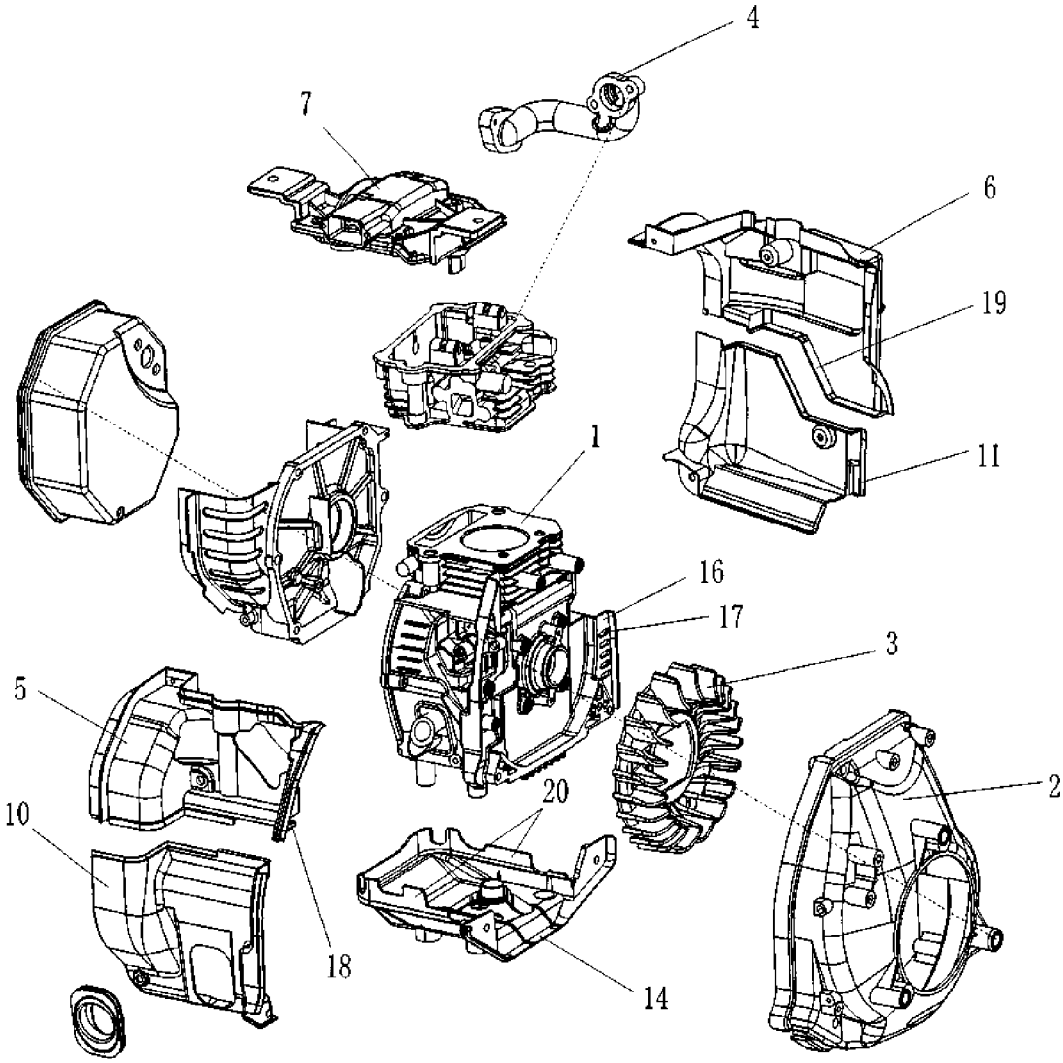
FIG. 3 is an assembly drawing of the present invention.
Figure 4:
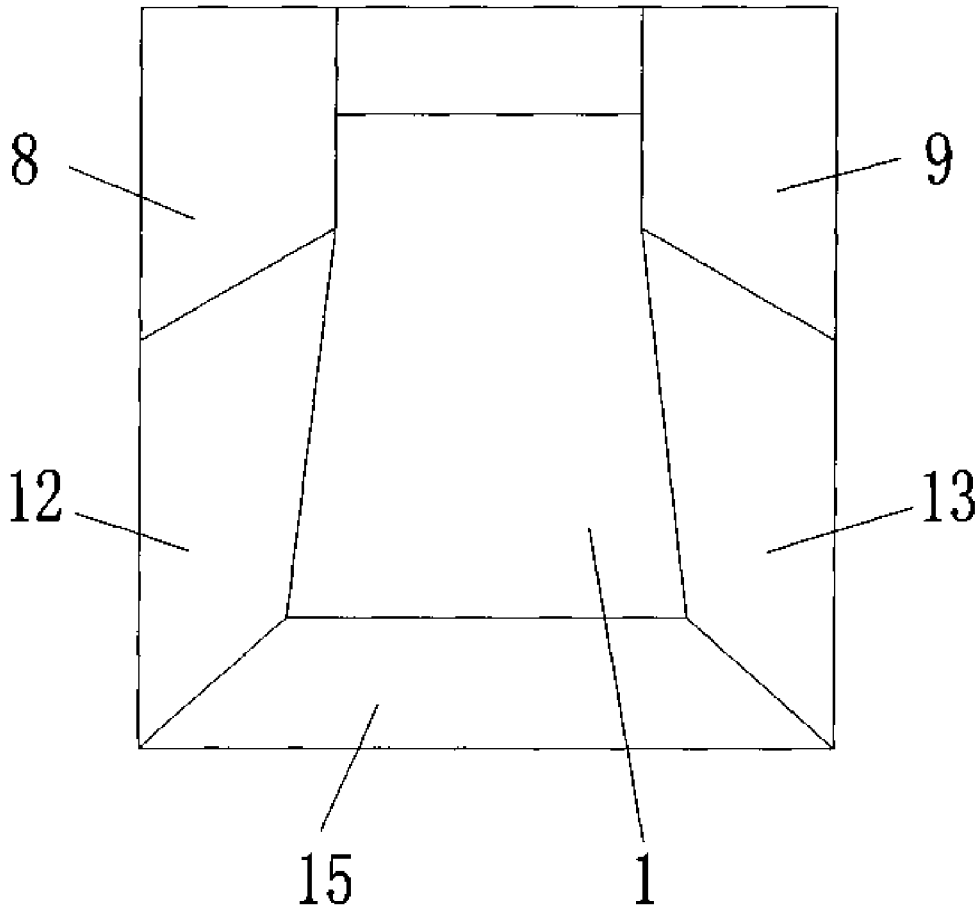
FIG. 4 is a schematic drawing of the air duct distribution of the present invention.
Figure 5:
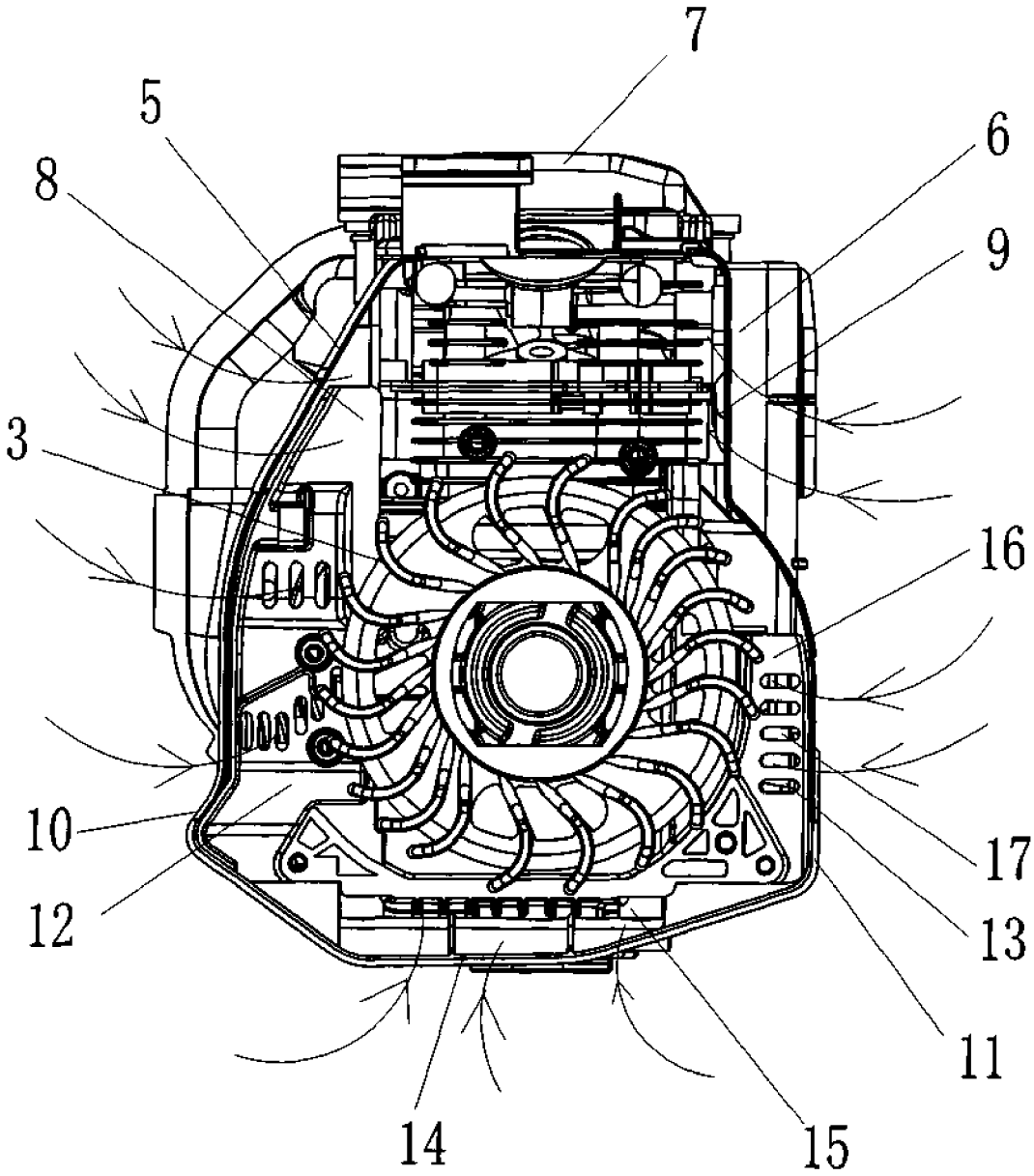
FIG. 5 is a drawing of the air duct distribution of the present invention.
Figure 6:
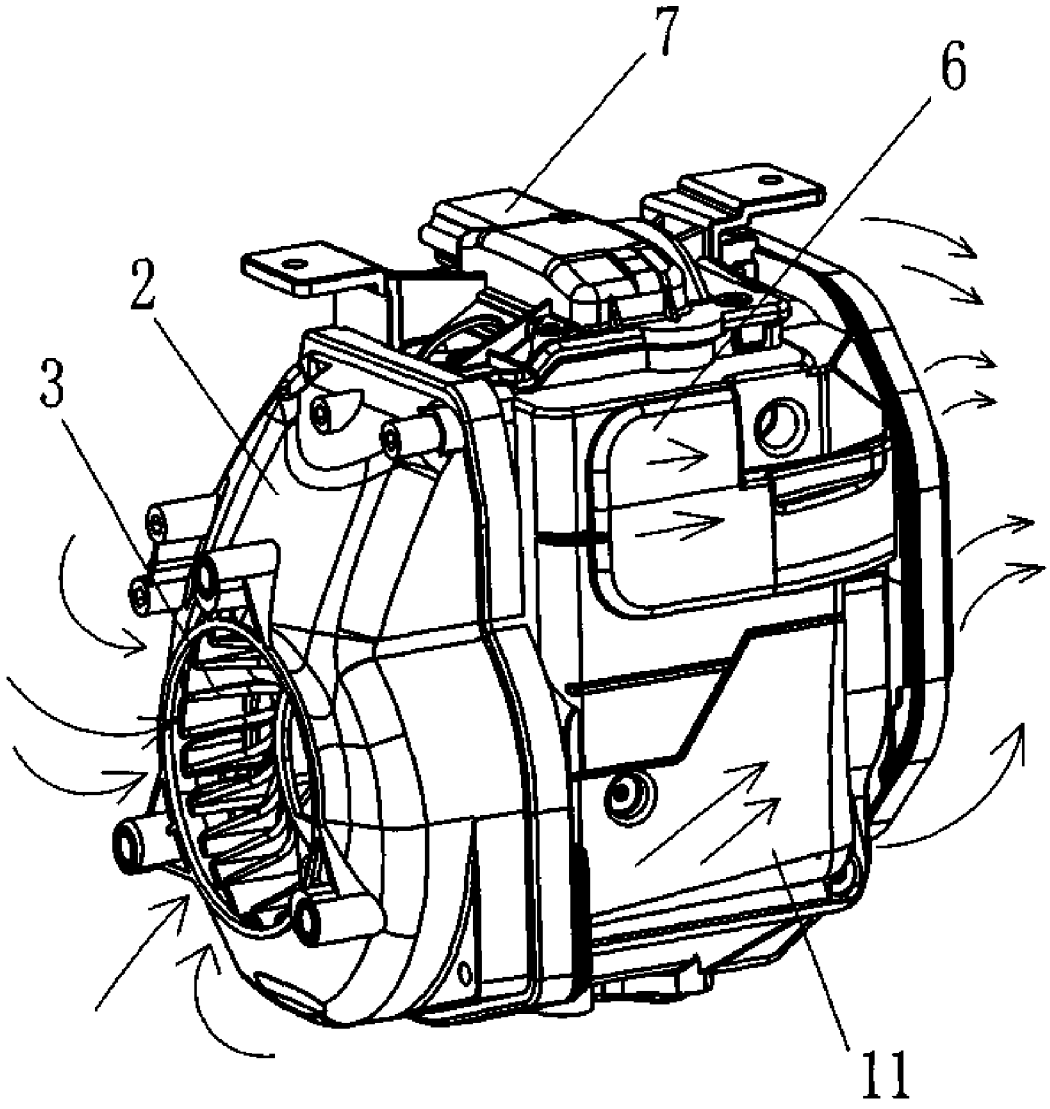
FIG. 6 is a drawing of the cooling air direction of the present invention.

As shown in FIGS. 1 to 6, a portable engine, comprising an engine casing 1, an air deflector cover 2, a fan 3 and an exhaust pipe 4; a left convex rib 18 extends inward at the junction between the left upper baffle plate 5 and the left lower baffle plate 10 at the left part of the engine; a right convex rib 19 extends inward at the junction between the right upper baffle plate 6 and the right lower baffle plate 11 at the right part of the engine; a left convex rib 18 and a right convex rib 19 constitute two left and right upper air ducts 8 and 9 together with a cylinder head cover 7 and the engine casing 1; an upper convex rib 20 extends upward respectively on the left and right sides of the base plate of the engine; the bottom air duct 15 is composed of the two upper convex ribs 20 and the engine casing 1; the left convex rib 18 and the right convex rib 19 constitute two left and right lower air ducts together with the upper convex ribs 20 and the engine casing 1; and two lower air ducts 12 and 13 are provided at the end close to the fan 3 respectively with an isolating plate 16, which is provided on the engine casing 1 and with several small vent holes 17.

The two upper air ducts 8 and 9 cool the cylinder head directly.

The two lower air ducts 12 and 13 can dissipate the heat produced by mechanical movements of the lower part of the engine during the engine operation and the heat conducted from the cylinder head.

The bottom air duct 15 can cool the cooling fin at the bottom of the engine casing 1, and therefore can well lower temperature of the engine oil.

The present invention can specifically cool each part through controlling air intake of each air duct, thus attaining better cooling effect for the engine.

What mentioned above is only an embodiment of the present invention, and cannot limit the extent of protection of the present invention. The present invention can also have other embodiments in addition to the above one. Any technical solution based on equal substitution or equivalent transform falls within the extent of protection the present invention claims.

What is claimed:

1. A portable engine comprising an engine casing, an air deflector cover, a fan and an exhaust pipe, wherein a left upper baffle plate and a right upper baffle plate at the upper part of the engine constitute two left and right upper air ducts together with a cylinder head cover and the engine casing, a left lower baffle plate and a right lower baffle plate at the lower part of the engine constitute two left and right lower air ducts together with the engine casing, and a base plate of the engine and the engine casing constitute a bottom air duct.

2. The portable engine according to claim 1, wherein a left convex rib extends inward at the junction between the left upper baffle plate and the left lower baffle plate, a right convex rib extends inward at the junction between the right upper baffle plate and the right lower baffle plate, the left and right upper air ducts are composed of the left convex rib, the right convex rib, the cylinder head cover and the engine casing, an upper convex rib extends upward respectively on the left and right sides of the base plate of the engine, the bottom air duct is composed of the two upper convex ribs and the engine casing, and the left and right lower air ducts are composed of the left convex rib, the right convex rib, the upper convex rib and the engine casing.

3. The portable engine according to claim 1 or 2, wherein the two lower air ducts are provided at the end close to the fan respectively with an isolating plate, which is provided with several small vent holes.

4. The portable engine according to claim 3, wherein the isolating plate is provided on the engine casing.

* * * * *